US011027957B2

(12) United States Patent
Hayakawa

(10) Patent No.: US 11,027,957 B2
(45) Date of Patent: Jun. 8, 2021

(54) DRINK FILLING SYSTEM

(71) Applicant: Dai Nippon Printing Co., Ltd., Tokyo (JP)

(72) Inventor: Atsushi Hayakawa, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 99 days.

(21) Appl. No.: 16/360,471

(22) Filed: Mar. 21, 2019

(65) Prior Publication Data

US 2019/0218089 A1 Jul. 18, 2019

Related U.S. Application Data

(63) Continuation of application No. 15/104,440, filed as application No. PCT/JP2014/083659 on Dec. 19, 2014, now Pat. No. 10,308,493.

(30) Foreign Application Priority Data

Dec. 25, 2013 (JP) ..... 2013-267063

(51) Int. Cl.
*B67C 7/00* (2006.01)
*B67C 3/22* (2006.01)
(Continued)

(52) U.S. Cl.
CPC ..... *B67C 7/0073* (2013.01); *B67C 3/22* (2013.01); *B67C 3/24* (2013.01); *B67C 7/004* (2013.01);
(Continued)

(58) Field of Classification Search
CPC ..... B67C 7/0073
(Continued)

(56) References Cited

U.S. PATENT DOCUMENTS 7,685,794 B2 3/2010 Nagatani et al.
2006/0185321 A1 8/2006 Raynaud
(Continued)

FOREIGN PATENT DOCUMENTS

CN 1180324 A 4/1998
CN 101018711 A 8/2007
(Continued)

OTHER PUBLICATIONS

Chinese Office Action (Application No. 201810310304.6) dated Sep. 26, 2019 (with English translation).
(Continued)

*Primary Examiner* — Lori L Baker
(74) *Attorney, Agent, or Firm* — Burr & Brown, PLLC

(57) ABSTRACT

A drink filling system including: a bottle molding section; a sterilizing section that sterilizes a molded bottle; a rinsing section that rinses the bottle; a filling section that fills and seals the bottle; and a conveying unit that conveys the bottle from the molding section to the filling section. A chamber covers a portion extending from the sterilizing section to the filling section, an atmosphere shut-off chamber is between a sterilizing section chamber and a rinsing section chamber, an exhaust unit for exhausting the atmosphere shut-off chamber and/or the sterilizing section chamber, a clean air supply unit for flowing a clean air from a filling section chamber into the atmosphere shut-off chamber through the rinsing section chamber or for further flowing the air into the sterilizing section chamber, and the air-flow flowing therein is exhausted by the exhaust unit.

3 Claims, 7 Drawing Sheets

(51) Int. Cl.
*B67C 3/24* (2006.01)
*B67C 3/26* (2006.01)

(52) U.S. Cl.
CPC .. *B67C 2003/227* (2013.01); *B67C 2003/228* (2013.01); *B67C 2003/2688* (2013.01)

(58) Field of Classification Search
USPC ..... 53/561, 167, 574; 425/326, 387
See application file for complete search history.

(56) References Cited

U.S. PATENT DOCUMENTS

| | | | |
|---|---|---|---|
| 2009/0071104 | A1 | 3/2009 | Fischer |
| 2010/0170867 | A1 | 7/2010 | Hayakawa |
| 2010/0199604 | A1 | 8/2010 | Fischer |
| 2011/0094616 | A1 | 4/2011 | Hayakawa et al. |

FOREIGN PATENT DOCUMENTS

| | | | | | |
|---|---|---|---|---|---|
| CN | 201275289 | Y | | 7/2009 | |
| CN | 103261033 | A | * | 8/2013 | ..... G01N 21/90 |
| EP | 2 103 528 | A1 | | 9/2009 | |
| EP | 2 279 952 | A1 | | 2/2011 | |
| EP | 2 653 395 | A1 | | 10/2013 | |
| JP | 2008-074438 | A1 | | 4/2008 | |
| JP | 2008-155941 | A1 | | 7/2008 | |
| JP | 2008-532866 | A | | 8/2008 | |
| JP | 2010-179943 | A1 | | 8/2010 | |
| JP | 2012-126436 | A | | 7/2012 | |
| JP | 2013-224183 | A1 | | 10/2013 | |
| WO | 2009/142198 | A1 | | 11/2009 | |
| WO | 2012/081489 | A1 | | 6/2012 | |

OTHER PUBLICATIONS

Japanese Office Action (and English translation obtained from the Global Dossier) from a corresponding Japanese patent application (JP 2018-232644) dated Oct. 15, 2019, 6 pages.
International Search Report and Written Opinion (Application No. PCT/JP2014/083659) dated Mar. 17, 2015.
European Search Report (Application No. 14875504.4) dated Jul. 26, 2017.
Chinese Office Action (Application No. 201480058092.7) dated Feb. 21, 2017 (with English translation).
Japanese Office Action (Application No. 2015-554821) dated Aug. 28, 2018 (with English translation).

* cited by examiner

DRINK FILLING SYSTEM

CROSS REFERENCE TO RELATED APPLICATIONS

This application is a continuation of U.S. application Ser. No. 15/104,440, filed Jun. 14, 2016, which in turn is the National Stage of International Application No. PCT/JP2014/083659, filed Dec. 19, 2014, which designated the United States, the entireties of which are incorporated herein by reference.

FIELD OF THE INVENTION

The present invention relates to a drink filling system for continuously performing a drink filling process through molding of a bottle and sterilizing the bottle with hydrogen peroxide.

BACKGROUND OF THE INVENTION

As a conventional drink filling system, there exists a system which is provided with a molding section for molding a bottle by blow-molding a preform, an inspection section for performing various inspections to the bottle molded in the molding section, a sterilizing section for sterilizing the inspected bottle by hydrogen peroxide mist, an air-rinsing section for air-rinsing the bottle sterilized in the sterilizing section, and a filling section for filling the bottle with the drink air-rinsed in the air-rinse section and then sealing the bottle, these sections being continuously connected, and a conveying means or unit for continuously conveying the bottle from the molding section to the filling section, in which a portion extending from the molding section to the filling section is covered by a chamber. An atmosphere shut-off chamber is also provided between the inspection section and the sterilizing section in such drink filling system so as to always exhaust air in the atmosphere shut-off chamber to an outside thereof by a blower or like means. According to such air exhausted from the atmosphere shut-off chamber, surplus mist of the hydrogen peroxide flowing into the sterilizing section is exhausted outside of the atmosphere shut-off chamber together with the inner air, thereby preventing the hydrogen peroxide from entering the inspection section and the molding section. Thus, various equipments and the like in the inspection section and the molding section can be protected from being damaged by the hydrogen peroxide (for example, refer to Patent Document 1).

PRIOR ART DOCUMENT

Patent Document

Patent Document 1: Japanese Patent Laid-Open Publication No. 2010-179943

SUMMARY OF THE INVENTION

Problem to be Solved by the Invention

In the conventional drink filling system, the inspection section takes relatively wide space. Hence, a apace for locating the atmosphere shut-off section can be ensured so as to be disposed inside the inspection section side, and accordingly, the atmosphere shut-off chamber is located between the inspection section and the sterilizing section. However, in an occasion such that the inspection by the inspection section is simplified or omitted, the chamber for the location of the inspection section is made narrow or eliminated, and in such occasion, the hydrogen peroxide likely leaks from the atmosphere shut-off chamber side to the inspection section side and the molding section side. Especially, since the chamber for the molding section has less air-tight property, the hydrogen peroxide will easily leak outside of the molding section chamber.

An object of the present invention is to provide a drink filling system capable of solving the problems mentioned above.

Means for Solving the Problem

In order to solve the above problems, the present invention adopts the following structure.

It is further to be noted that although the description is made with parentheses to reference numerals for easy understanding of the invention, the present invention is not limited thereto.

That is, the present invention according to a first aspect adopts a drink filling system which includes: a molding section (8) that molds a bottle (1) from a heated preform (6) by a blow-molding treatment; a sterilizing section (9) that contacts a sterilizer to the molded bottle; a rinsing section (10) that rinses the bottle discharged from the sterilizing section; a filling section (11) that fills the bottle rinsed in the rinsing section with a drink and then seals the bottle filled up with the drink; and a bottle conveying unit that continuously conveys the bottle on a bottle conveying path from the molding section to the filling section through the sterilizing section and the rinsing section, and in which at least a portion extending from the sterilizing section to the filling section is covered by a chamber, wherein an atmosphere shut-off chamber (32) is provided between a sterilizing section chamber (9*a*) and a rinsing section chamber (10*a*), an exhaust unit is provided for at least one of the atmosphere shut-off chamber (32) and the sterilizing section chamber (9*a*), a clean air supply unit is provided for a filling section chamber (11*a*) so that a clean air flows from the filling section chamber into the atmosphere shut-off chamber through the rinsing section chamber or further flows into the sterilizing section chamber, and the air-flow flowing therein is exhausted by an exhaust unit.

Further, the clean air is, for example, aseptic air.

According to a second aspect of the present invention, in the drink filling system according to the first aspect, it may be desired that the molding section (8) is covered by a molding section chamber (8*a*), an air supply section chamber (25) is provided between the molding section chamber (8*a*) and the sterilizing section chamber (9*a*), a clean air supply unit is provided for the air supply section chamber (25), and the clean air supplied from the clean air supply unit flows from the interior of the air supply section chamber into the molding section chamber (8*a*) and the sterilizing section chamber (9*a*).

According to a third aspect of the present invention, in the drink filling system according to the second aspect, it may be desired that the clean air supply unit (25) is provided with a heater (29), and the heated clean air is supplied into the air supply chamber.

According to a fourth aspect of the present invention, in the drink filling system according to any one of the first to third aspects, it may be desired that a portion of the sterilizing section chamber (9*a*) at which the bottle (1) travels while being applied with a sterilizer is covered with a tunnel member (49).

Effects of the Invention

That is, the present invention according to the first aspect provides a drink filling system which includes: a molding section (8) that molds a bottle (1) from a heated preform (6) by a blow-molding treatment; a sterilizing section (9) that contacts a sterilizer to the molded bottle; a rinsing section (10) that rinses the bottle discharged from the sterilizing section; a filling section (11) that fills the bottle rinsed in the rinsing section with a drink and then seals the bottle filled up with the drink; and a bottle conveying unit that continuously conveys the bottle on a bottle conveying path from the molding section to the filling section through the sterilizing section and the rinsing section, and in which at least a portion extending from the sterilizing section to the filling section is covered by a chamber, wherein an atmosphere shut-off chamber (32) is provided between a sterilizing section chamber (9*a*) and a rinsing section chamber (10*a*), an exhaust unit is provided for at least one of the atmosphere shut-off chamber (32) and the sterilizing section chamber (9*a*), a clean air supply unit is provided for a filling section chamber (11*a*) so that a clean air flows from the filling section chamber into the atmosphere shut-off chamber through the rinsing section chamber or further flows into the sterilizing section chamber, and the air-flow flowing therein is exhausted by an exhaust unit. Accordingly, even if a conventional inspection section is simplified for making compact the inspection section chamber or eliminated, the sterilizer such as hydrogen peroxide can be prevented from leaking into the inspection section side and the molding section side, and thus, the leaking of the sterilizer out of the molding section chamber (8*a*) having low air-tightness.

According to the second aspect, in the drink filling system according to the first aspect, the molding section (8) is covered by a molding section chamber (8*a*), an air supply section chamber (25) is provided between the molding section chamber (8*a*) and the sterilizing section chamber (9*a*), a clean air supply unit is provided for the air supply section chamber (25), and the clean air supplied from the clean air supply unit flows from the interior of the air supply section chamber into the molding section chamber (8*a*) and the sterilizing section chamber (9*a*). According to such structure, the surplus sterilizer in the sterilizing section (9) can be prevented from flowing to the molding section (8) side by the clean air flowing into the air supply section chamber (25).

According to the third aspect, in the drink filling system according to the second aspect, the clean air supply unit (25) is provided with a heater (29), and a heated clean air is supplied into the air supply section chamber (25). According to such structure, since the bottle (1) conveyed out of the molding section (8) is conveyed to the sterilizing section (9) with the predetermined temperature heated by the clean air being kept, the sterilizing effect to the bottle (1) in the sterilizing section (9) can be enhanced.

Furthermore, there is a fear such that when gas of a sterilizer such as hydrogen peroxide is highly concentrated in the sterilizing section chamber (9*a*), the bottle (1) is dewed on the conveying line, which may intrude into the bottle (1). In order to obviate such defect, the heated clean air is supplied from the chamber (9*a*) to the air supply section chamber (25), and according to such heated clean air supply, the sterilizer gas concentration is lowered and the saturated steam pressure is increased, thereby preventing the sterilizer such as hydrogen peroxide from dewing.

According to the fourth aspect, in the drink filling system according to any one of the first to third aspects, a portion of the sterilizing section chamber (9*a*) at which the bottle (1) travels while being applied with a sterilizer is covered with a tunnel member (49). According to this structure, it is possible to prevent turbulence flow of the sterilizer, which is to uniformly adhere to the bottle (1), from causing, and the air discharging can be performed while the sterilizer uniformly adhering to the bottle (1).

DETAILED DESCRIPTION OF THE INVENTION

Hereunder, exemplary embodiments of the present invention will be explained.

First Embodiment

Figure 1:
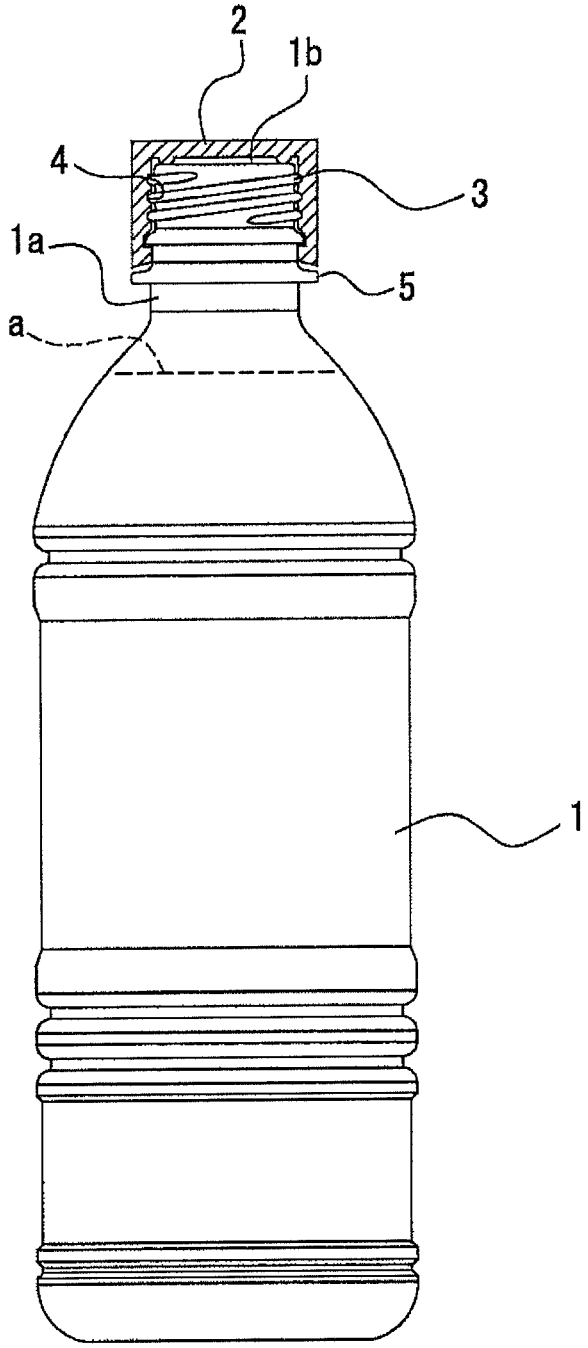
FIG. 1 is a front view of a bottle as a package manufactured by a drink filling system according to the present invention.

First, a package manufactured by the drink filling system of the first embodiment will be explained. This package is provided, as shown in FIG. 1, with a bottle 1 as a container and a cap 2 as a lid, and reference character "a" denotes drink filling the bottle 1.

Although a body of the bottle 1 is formed to be approximately cylindrical, it may take any other shape such as rectangular shape. A bottom of the bottle 1 is closed as bottomed portion and a neck portion (i.e., mouth portion) 1*a* having a circular opening is formed to an upper side portion of the body.

The neck portion 1*a* is formed with a male thread 3, and a female thread 4 is also formed to the cap 2, and when the male and female threads 3 and 4 are screw-engaged, the opening of the neck portion 1*a* is sealed. A support ring 5 is formed to the neck portion 1*a* of the bottle 1 at a portion below the male thread 4. The bottle 2 travels within the drink filling system while being held by a gripper 7 shown in FIG. 3 through the support ring 5, as described hereinafter.

Figure 3:
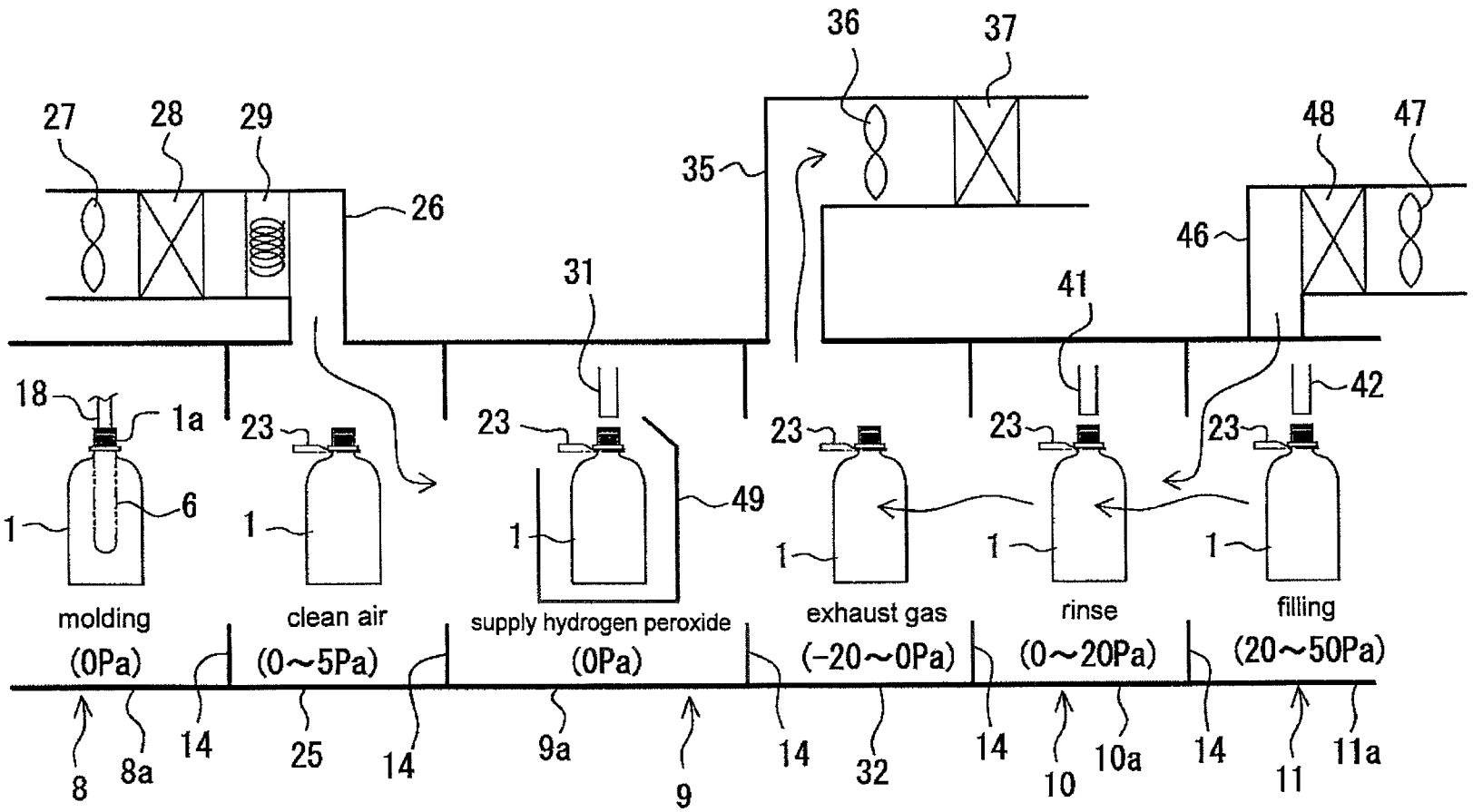
FIG. 3 is a sectional view taken along the line shown in FIG. 2.

The bottle 1 is formed by blow-molding a preform 6 made of PET having approximately a test-tube shape shown in FIG. 3. The bottle 1 may be formed of, not limited to the PET, other resin material such as polypropylene, polyethylene or the like. The preform 6 is molded by injection molding process and is formed with a neck portion 1*a* at an upper portion of approximately cylindrical body portion, as like as in the bottle 1. A male thread 3 is formed to this neck portion 1*a* at the same time of molding the preform 6.

The cap 2 is formed of a resin material such as polyethylene, polypropylene or the like by the injection molding process, and a female thread 4 is also formed at the same time of molding the cap 2.

Hereunder, the drink filling system for filling the bottle 1 with the drink "a" will be explained.

Figure 2:
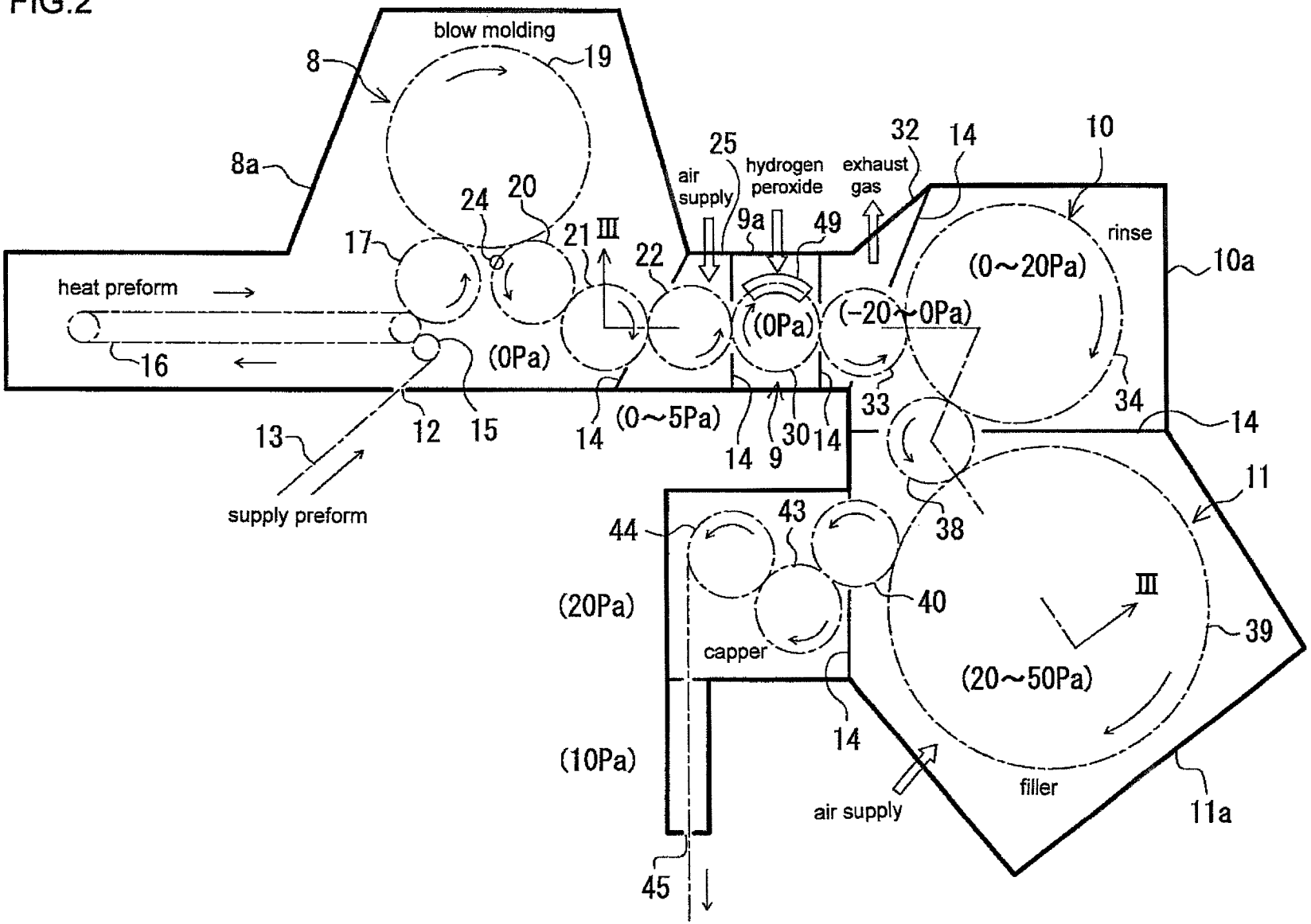
FIG. 2 is a schematic plan view of a drink filling system according to the first embodiment of the present invention.

As shown in FIGS. 2 and 3, the drink filling system is provided with a molding section 8 for molding the bottle 1, a bottle sterilizing section 9, a bottle rinsing section 10, and a filling section for filling the bottle 1 with the drink "a" and then sealing the bottle 1.

The molding section 8 is covered by a chamber 8*a* for the bottle molding section 8, the sterilizing section 9 is covered by a chamber 9*a* for the bottle sterilizing section 9, the rinsing section 10 is covered by a chamber 10*a* for the bottle rinsing section 10, and the filling section 11 is covered by a chamber 11*a* for the bottle filling section 11. These chambers are mutually connected next to each other to thereby constitute an integral system or unit. Partition wall sections 14 are disposed between the adjacent chambers.

The chamber 8*a* for the molding section 8 is formed with a supply port 12 for supplying the preform 6 into the molding section chamber 8*a*. The molding section chamber 8*a* is for protecting a blow-molding equipment and so on, and since the molding section chamber 8*a* is communicated with atmosphere at various portions, an inner pressure thereof is maintained at substantially the same as the atmospheric pressure of 0 Pa.

A preform supplying machine, not shown, is disposed near the molding section chamber 8*a*, and a plurality of preforms 6, shown in FIG. 3, are loaded in the preform supplying machine. The preform supplying machine supplies the preforms 6, each in a normally standing attitude in which the neck portion 1*a* thereof is directed upward as shown in FIG. 3, into the molding section 8 through the supply port 12 by means of a preform conveyer 13.

Since the preform supplying machine is known one, details thereof are omitted herein.

As shown in FIG. 2, within the molding section chamber 8*a*, a preform conveying path, a preform molding path and a bottle conveying path are provided.

The preform conveying path is equipped with a wheel 15 that receives the preform 6 conveyed by the preform conveyer 13, an endless conveyer 16 that conveys the preform 6 conveyed by the preform conveyer 13, and a wheel 17 that receives the preform 6 from the wheel 15 and transfer the preform 6 to a bottle molding path side.

As shown in FIG. 3, a plurality of mandrels 18 are disposed at equal pitch on a way from the preform conveying path 6 toward the bottle molding path, and these mandrels 18 reciprocate between the preform conveying path and the bottle molding path. Each mandrel 18 enters the mouth portion (i.e., neck portion) 1*a* of each of the preforms 6 conveyed by the preform conveyer 13 and is moved toward the bottle molding path while holding the preform 6.

Heaters, not shown, are disposed on both sides of the endless conveyer 16, and the portion of the preform 6 below the mouth portion 1*a* thereof is heated to a temperature suitable for the blow-molding process while the preform 6 is conveyed along the endless conveyer 16.

The bottle molding path is arranged around a wheel 19 having a relatively large diameter, and a plurality of molding dies (molds), not shown, which perform turning motion in a horizontal plane synchronously with the rotation of the wheel 19, are arranged at a predetermined pitch.

The molding die is a mold for blow-molding treatment which is dividable into two parts, and when the heated preform 6 reaches from the wheel 17 disposed upstream side thereof, the mold travels on the bottle molding path around the wheel 19 and clamps the preform 6 together with the mandrel 18. The mandrel 18 is formed with a through hole at its central axis portion, and when a blow-nozzle, not shown, is inserted into this through hole and gas such as air is blasted into the preform 6 by the blow-nozzle, the preform 6 is molded to the bottle 1 into the mold. When the mold approaches the bottle conveying path, the mold is opened to thereby release the bottle 1.

In this moment, the mandrel 18 is taken out of the mouth portion 1*a* of the bottle 1 to thereby release the bottle 1. Thereafter, the mandrel 18 returns to the preform conveyer path side.

The bottle conveying path is provided, as shown in FIG. 2, a wheel 20 that receives the bottle 1 released from the mold, and a wheel 21 that receives the bottle 1 from the wheel 20 and transfers that bottle 1 to a wheel 22 disposed downstream side thereof.

A plurality of grippers 23 shown in FIG. 3 are disposed on the bottle conveying path at a predetermined pitch. Each of the grippers 23 moves circularly around each of the wheels, and the gripped bottle 1 is transferred from the gripper of the upstream side wheel 20 to the gripper of the downstream side wheel 21.

A camera 24 as the inspection unit for inspecting an end face 1*b* (see FIG. 1) of the mouth portion 1*a* of the bottle 1 is located as occasion demands. On observation of a photographed image by the camera 24, there is discriminated smoothness of the end face 1*b* of the mouth portion 1*a* of the bottle 1, and presence of air bubbles, slippage of bottom gate, scuff, foreign material or like. In such discrimination, when any defective smoothness or like in an end face 1*b* of a bottle 1 is observed to be considered as defective is removed from the bottle conveying path by a bottle rejecting means, not shown. As described, only by filing the bottles 1, which have been considered to have good smoothness of the end faces 1*b* (not defective) bottles 1, with the drink "a", the air-tightness of the bottle 1 can be maintained for a long time when the mouth portion 1*a* of the bottle 1 is thereafter closed.

The bottle conveying path extends toward the sterilizing section chamber 9*a*, the rinsing section chamber 10*a* and the filling section chamber 11*a* which are arranged downstream side of the molding section chamber 8*a*, and within these chambers, the bottles 1 are conveyed by means of grippers like ones of the grippers 23 mentioned hereinbefore.

Further, although the sterilizing section chamber 9*a* is arranged downstream side of the molding section chamber 8*a*, an air supply section chamber 25 may be arranged between these chambers 8*a* and 9*a* as occasion demands as shown in FIGS. 2 and 3.

The air supply section chamber 25 is connected, as shown in FIG. 3, to an air supply duct 26 as clean air supply means, to which an air supply blower 27, a filter 28 and a heater 29 are connected in order. The air cleaned by the filter 28 is heated by the heater 29, and the heated clean air is supplied into the air supply section chamber 25.

Furthermore, as shown in FIG. 2, in the air supply section chamber 25, the wheel 22 constituting a part of the bottle conveying path is disposed in connection with the wheel 21 disposed in the molding section chamber 8*a*. The bottle 1 conveyed from the molding section 8 is blasted with the air during the time of its traveling around the wheel 22, so that the temperature of the bottle 1 heated in the state of the preform 6 can be maintained or prevented from lowering in the temperature, otherwise being further heated. According to such operation, the sterilizing effect to the bottle 1 sterilized in the next sterilizing section 9 can be enhanced.

As a result of the clean air supply into the air supply section chamber 25, the pressure in the air supply section chamber 25 is maintained to be 0 Pa to 5 Pa, for example, and the clean air flowing into the air supply section chamber 25 flows form the interior of the air supply section chamber 25 toward the downstream side molding section chamber 8*a* and the downstream side sterilizing section chamber 9*a*.

It is further to be noted that the air supply section chamber 25 and the wheels 21 and 22 may be eliminated, and the bottle 1 may be directly conveyed from the molding section 8 to the sterilizing section 9.

As shown in FIG. 2, within the sterilizing section chamber 9*a*, a wheel 30 constituting a part of the bottle conveying path is disposed in connection to the wheel 22 disposed in the air supply section chamber 25.

A nozzle 31 as sterilizer supplying means for supplying hydrogen peroxide mist or gas as sterilizer to the bottle 1 is provided to a predetermined portion around the wheel 30. The nozzle 31 has an exhaust port formed to a tip end thereof is positioned so as to directly face the opening of the mouth portion 1*a* of the bottle 1 which is now traveling directly below the tip end exhaust port of the nozzle 31.

One or plural nozzles 31 may be arranged along the bottle conveying path around the wheel 30.

The hydrogen peroxide mist can be produced by a known mist generator.

The bottle 1 is conveyed around the wheel 30 in a state such that the mouth portion 1*a* thereof is directed upward, and the exhaust port of the lower end of the nozzle 31 is opened toward the mouth portion 1*a* of the bottle 1 at the upper position of the conveying path position. In this position, the hydrogen peroxide gas fed to the nozzle 31 from the mist generator is changed into condensed hydrogen peroxide mist, which is then blasted continuously toward the mouth portion 1*a* of the bottle 1 from the exhaust port of the nozzle 31. A part of the blasted condensed hydrogen peroxide mist flows into the bottle 1, now travelling, through the mouth portion 1*a* thereof to thereby sterilize the inner surface of the bottle 1, and another part of the blasted condensed hydrogen peroxide mist flows outside of the bottle 1 to thereby sterilize the outer surface of the bottle 1.

Since only the hydrogen peroxide mist is supplied into the sterilizing section chamber 9*a*, the inner pressure in the sterilizing section chamber 9*a* is maintained to, for example, about atmospheric pressure of 0 Pa.

A portion in the sterilizing section chamber 9*a* in which the bottle 1 travels while being supplied with the sterilizer is covered by a tunnel member 49 as occasion demands. In such case, when the bottle 1 enters the sterilizing section chamber 9*a* and then enters the tunnel member 49, the hydrogen peroxide mist or gas, or mixture thereof is blasted to the bottle 1. Accordingly, the hydrogen peroxide mist or gas, or mixture thereof, as the sterilizer flowing out of the nozzle 31, flows smoothly into the bottle 1 without being disturbed by a turbulence flow flowing in the sterilizing section chamber 9*a* or smoothly flows along the outer surface of the bottle 1.

The rinsing section chamber 10*a* is located downstream side of the sterilizing section chamber 9*a* as viewed in the bottle conveying path direction, and as shown in FIGS. 2 and 3, an atmosphere shut-off chamber 32 is arranged between both the chambers 9*a* and 10*a*.

As shown in FIG. 2, within the atmosphere shut-off chamber 32, a wheel 33 constituting a part of the bottle conveying path is located so as to be continuously connected to the wheel 30 in the sterilizing section chamber 9*a* and a wheel 34, described later, in the rinsing section chamber 10*a*. According to such arrangement of the wheels, the bottle transferred from the sterilizing section 9 travels toward the rinsing section 10 through the atmosphere shut-off chamber 32.

As shown in FIG. 3, an exhaust duct 35 as exhaust means is connected to the atmosphere shut-off chamber 32, and a blower 36 for exhaust and a filter 37 are provided for the exhaust duct 35.

Gas in the atmosphere shut-off chamber 32 flows into the exhaust duct 35 by means of the exhaust blower 36 and is then filtrated by the filter 37, and after the filtration, the gas is exhausted out of the atmosphere shut-off chamber 32. In accordance with the operation of such exhaust means, the pressure in the atmosphere shut-off chamber 32 is maintained within about −20 Pa to 0 Pa, for example. As a result, air (gas) flows into the atmosphere shut-off chamber 32 from the upstream side sterilizing section chamber 9*a* and the downstream side rinsing section chamber 10*a*, and is then exhausted out of the atmosphere shut-off chamber 32 through the exhaust duct 35. According to such air flow, the hydrogen peroxide exhausted in the sterilizing section 9 does not flow into the upstream side molding section chamber 8*a* and the downstream side filling section chamber 11*a*, so that various equipments and components in the molding section 8 can be prevented from corroding by the hydrogen peroxide.

The rinsing section chamber 10*a* is located on the downstream side of the atmosphere shut-off chamber 32.

As shown in FIG. 2, a wheel 34 constituting a part of the bottle conveying path is located within the rinsing section chamber 10*a*, and a number of nozzles 41, one shown in FIG. 3, are arranged around the wheel 34 at a predetermined pitch to be rotatable with the wheel 34. Clean air from an air supply source, not shown, is distributed to each of nozzles 41, after being heated, via a manifold. When a valve for each nozzle 41 is opened, the clean air is blasted into the bottle 1.

The bottle 1 turns around the wheel 34 while being held by the gripper 23, and the air is blasted to the bottle 1 from the nozzle 41. The air from the nozzle 41 contacts the inner and outer surfaces of the bottle 1 to thereby remove the surplus amount of the hydrogen peroxide supplied to the bottle 1 from the nozzle 41. At the same time, the hydrogen peroxide adhering to the bottle 1 is heated to be activated, thereby enhancing the sterilizing effect. Furthermore, by such air blasting, the pressure within the rinsing section chamber 10*a* is maintained, for example, at about 20 Pa. As a result, air flow toward the upstream side atmosphere shut-off chamber 32 from the rinsing section chamber 10*a* is caused.

Further, although the above-described rinsing section 10 is an air rinsing section using air, it may be replaced with a hot-water rinsing section using hot water. It may be also available to locate a hot water rinsing section following the air rinsing section. Furthermore, with reference to FIG. 3, although the air rinsing is performed to the bottle 1 in positive vertical attitude, in which the mouth portion 1*a* being directed upward, the air rinsing may be performed to the bottle 1 in an inverted state.

Within the filling section chamber 11*a* disposed downstream side of the rinsing section chamber 10*a*, wheels 38, 39 and 40 are disposed in series so as to constitute a part of the bottle conveying path. Among these wheels, a number of filling nozzles 42 shown in FIG. 3 are arranged around the wheel 39 having a large diameter at a predetermined pitch so as to be rotatable together with the wheel 39, so that the wheel 39 and a portion around the wheel 39 are constituted as a filler. The sterilized drink supplied from the drink supply source, not shown, is distributed to all the filling nozzles 42 via a manifold. The bottle 1 is turned around the wheel 42 with being held by the gripper 23, and when a valve of each filling nozzle 42 is opened, the drink is fed into each bottle 1 with predetermined amount.

A capper is located on the downstream side of the filler within the filling section chamber 11*a*. The capper is disposed on the downstream side of the filler in the filling section chamber 11*a*. This capper is a device for applying the cap 23 to the mouth portion 1*a* of the bottle 1 filled up with the drink and turning around the wheel 43 with the bottle 1 being held by the gripper 23. The wheel 43 is connected, on its upstream side, to the wheel 39 of the filler through the intermediate wheel 40 and also connected, on its downstream side, to the wheel 44 for discharging the bottle 1 outside the filling section chamber 11*a*. The mouth portion 1*a* of the bottle 1 filled with the drink is closed and sealed with the cap 2 at the time of traveling around the wheel 43 in the capper. Thereafter, the bottle 1 is conveyed out of the filling section chamber 11*a*, as a bottle filled up with drink, from a convey-out port 45 of the filling section chamber 11*a* through the discharge wheel 44.

Furthermore, the filling section chamber 11*a* is provided, as shown in FIG. 3, with a clean air supply means. That is, the air supply duct 46 is connected to the filling section chamber 11*a*, and an air supply blower 47 and a filter 48 are provided for the air supply duct 46. The clean air is continuously supplied into the filling section chamber 11*a* by such clean air supply means, and accordingly, the inner pressure inside the filling section chamber 11*a* is maintained at, for example, 20 to 50 Pa.

According to the arrangement described above, the outdoor air including bacteria and the like can be prevented from intruding into the filling section 11. In addition, the clean air flowing into the filling section chamber 11*a* flows to the atmosphere shut-off chamber 32 through the air rinsing section chamber 10*a* and then exhausted from the exhaust duct 35 externally out of the atmosphere shut-off chamber 32, and the clean air flowing into the filling section chamber 11*a* also flows toward the capper side.

Further, a conveyer for discharging the bottle (discharge conveyer) is provided to a portion near the side of the exhaust port 45 of the filling section chamber 11*a* so as to extend from the discharge wheel 44 toward the exhaust port, and a sterilizing tank, not shown, into which the discharge conveyer is dipped for sterilization, is also provided near the exhaust port 45. Within such sterilizing tank, for example, peracetic acid is stored, and this peracetic acid is liable to be evaporated within the filling section chamber 11*a*. Then, a duct, not shown, is provided near the exhaust port 45 of the filling section chamber 11*a*, and this duct is connected to the duct 35 shown in FIG. 3. According to such connection, the peracetic acid evaporated from the sterilizing tank is exhausted from the duct out of the chamber together with the hydrogen peroxide mist.

The operation and function of the drink filling system described above will be explained hereunder.

(1) A plurality of the preforms 6 as shown in FIG. 3 are prepared, and supplied into the molding section chamber 8*a* by the conveyer 13 for supplying the preforms 6.

(2) The preform 6 supplied into the molding section chamber 8*a* is first held by the mandrel 18 such as shown in FIG. 3, and then heated by the heater, while being conveyed together with the mandrel by the endless conveyer 16, till a predetermined portion of the preform is heated to a temperature suitable for the blow-molding treatment.

(3) The thus heated preform 6 is then transferred to the gripper from the mandrel 18. Thereafter, the preform 6 is clamped by the mold (forming mold) turning around the wheel 19, and blasted with the air from the flow-nozzle, not shown, during the conveyance on the bottle conveying path. In this manner, the bottle 1 is molded in the mold.

The molded bottle 1 is transferred outside of the mold by the gripper 23 after the opening of the mold, travels around the wheel 20 while being held by the gripper 23 of the wheel 20, and then is inspected by the camera 24 for inspecting the end face 1*b* of the mouth portion 1*a* of the bottle 1. As a result of the inspection, the bottle 1 having bad (defective) flatness is removed from the bottle conveying path by a rejection device.

Then, the mandrel 18 returns to the side of the endless conveyer 16 for conveying the preform 6.

(4) The bottle 1 having no defective (having good flatness) is conveyed from the molding section chamber 8*a* to the air supply section chamber 25. Since the clean air is always blasted into the air supply section chamber 25 via the air supply duct 26, the bottle 1 is conveyed into the sterilizing section chamber 9*a* while passing through the clean air atmosphere. Further, it is to be noted that such clean air may be heated.

(5) The bottle 1 entering the sterilizing section chamber 9*a* is blasted with the hydrogen peroxide mist, and the hydrogen peroxide mist or gas hence adheres evenly to the inner and outer surfaces of the bottle 1. At this time, since the bottle 1 has a remaining heat by the heater before the molding treatment and is heated by the clean air heated in the air supply section chamber 25, the hydrogen peroxide adhering to the bottle 1 is activated, thus enhancing the sterilizing effect.

(6) The bottle 1 to which the hydrogen peroxide mist adheres enters the atmosphere shut-off chamber 32, which is always exhausted by the exhaust blower 36, so that the inner pressure of the atmosphere shut-off chamber 32 is maintained at, for example, −20 Pa to 0 Pa, which is lower than the atmospheric pressure.

Because of the reason mentioned above, air flow including the hydrogen peroxide mist flows into the atmosphere shut-off chamber 32 from the sterilizing section chamber 9*a* disposed upstream side thereof, and air flow for the rinsing treatment also flows into the atmosphere shut-off chamber 32 from the rinsing section chamber 10*a* disposed downstream side thereof, and both the air flows are exhausted out of the atmosphere shut-off chamber 32 from the exhaust duct 35.

Accordingly, the hydrogen peroxide exhausted from the sterilizing section 9 is prevented from entering the molding section chamber 8*a* disposed upstream side thereof and entering the filling section chamber 11*a* disposed downstream side thereof, thereby preventing the hydrogen peroxide from adhering to or mixing in various equipments or components in the molding section 8 and adhering to or mixing in the bottle 1 and the drink in the filling section 11.

Furthermore, since the heated air for rinsing treatment flows into the atmosphere shut-off chamber 32, the bottle 1 is not excessively cooled and is maintained at an appropriately heated temperature.

(7) The bottle 1 passing through the atmosphere shut-off chamber 32 enters the rinsing section chamber 10*a* in the state that the hydrogen peroxide mist adheres to the surface of the bottle 1.

Since the heated clean air is always blasted into the rinsing section chamber 10*a*, the hydrogen peroxide adhering to the surface of the bottle 1 is activated by the heat of the heated clean air, and hence, the sterilizing effect can be enhanced. In addition, by the rinsing effect by the clean air, the surplus hydrogen peroxide can be removed from the surface of the bottle 1.

(8) The rinsed bottle 1 is then conveyed into the filling section chamber 11*a*, in which the predetermined amount of the drink fills the bottle 1 through the mouth portion 1*a* thereof, and then, is sealed by applying the cap 2 by the capper. Thereafter, the bottle 1, as a drink package, is conveyed out of the filling section chamber 11*a* through exhaust port 45.

The clean air is always supplied into the filling section chamber 11*a*. The inner pressure of the filling section chamber 11*a* is maintained by the supply of the clean air to be higher than the pressure inside the rinsing section chamber 10*a*. Because of this reason, there causes an air flow flowing from the filling section chamber 11*a* toward the atmosphere shut-off chamber 32 through the rinsing section chamber 10*a*. Such air flow is exhausted out of the atmosphere shut-off chamber 32 through the exhaust duct 35 from the atmosphere shut-off chamber 32 as mentioned hereinbefore.

Second Embodiment

Figure 4:
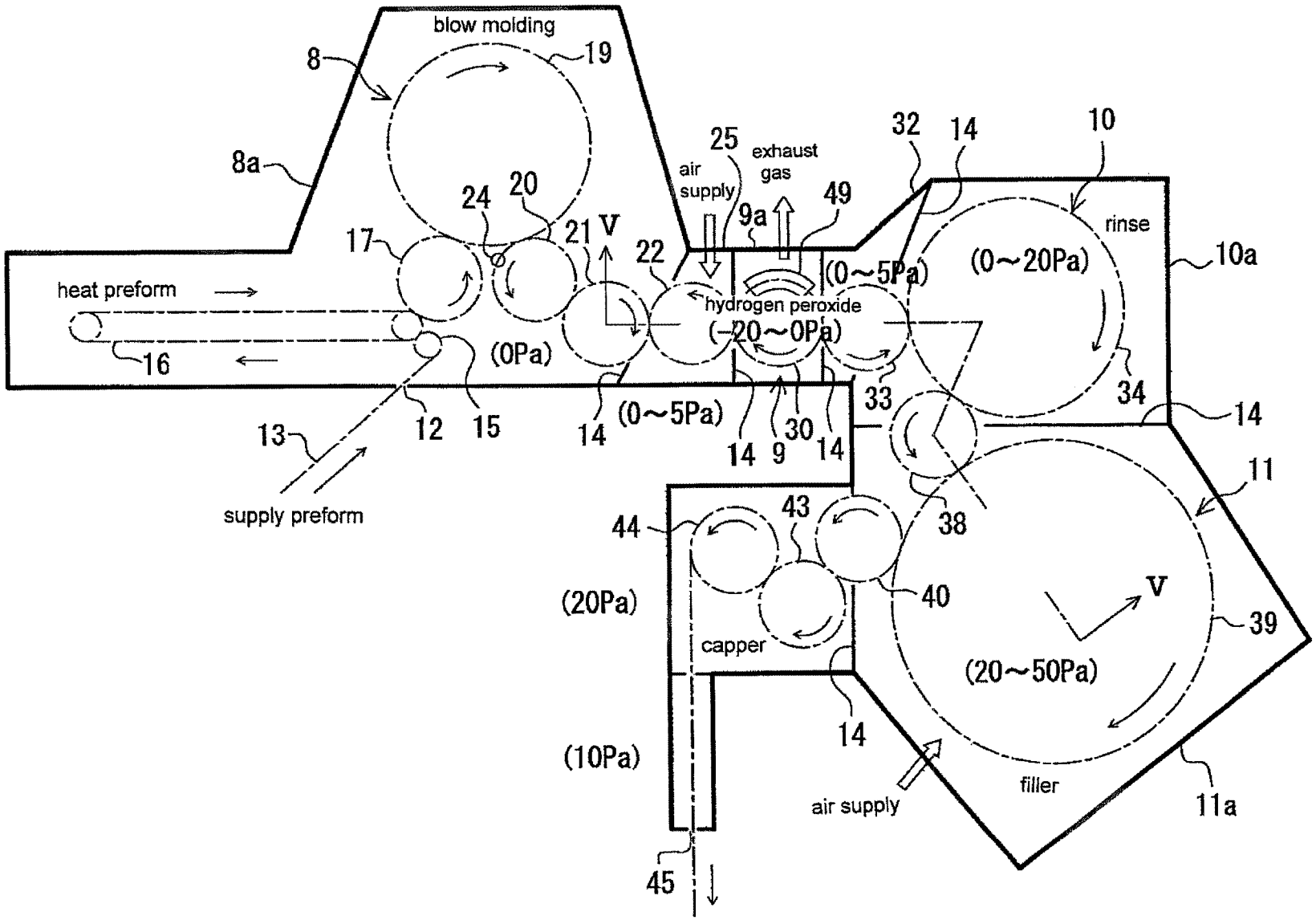
FIG. 4 is a schematic plan view of a drink filling system according to the second embodiment of the present invention.
Figure 5:
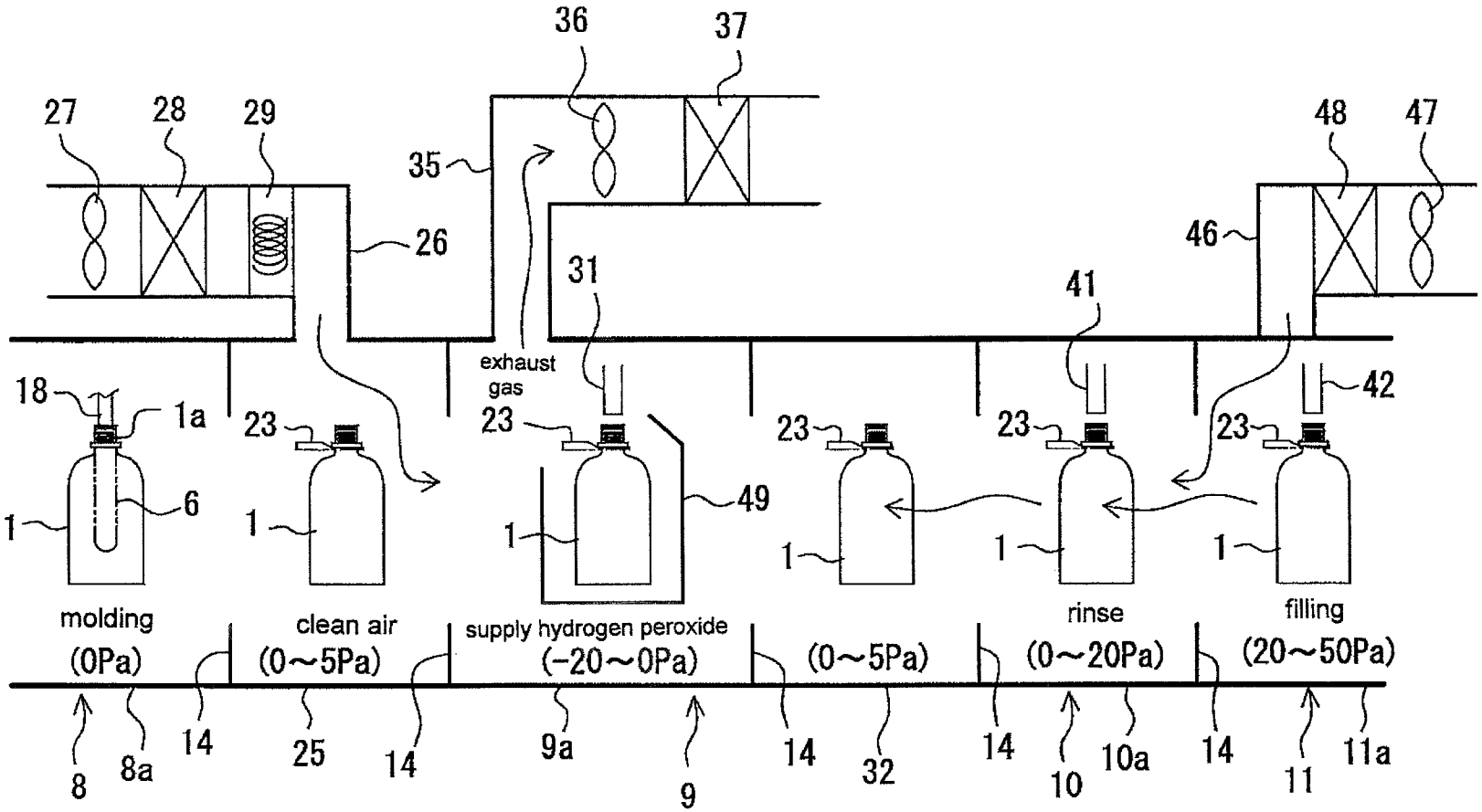
FIG. 5 is a sectional view taken along the line V-V shown in FIG. 4.

As shown in FIGS. 4 and 5, the drink filling system of this embodiment is provided with the sterilizing section chamber 9*a* on the downstream side of the molding section chamber 8*a*, as in the first embodiment, as viewed from the bottle conveying direction, and the air supply section chamber 25 may be also provided, as occasion demands, between both the chambers 8*a* and 9*a*.

Furthermore, the rinsing section chamber 10*a* is arranged on the downstream side of the sterilizing section chamber 9*a* as viewed from the bottle conveying direction, and the atmosphere shut-off chamber 32 is also arranged between both the chambers 9*a* and 10*a*.

However, in this second embodiment, the exhaust means provided for the atmosphere shut-off chamber 32 in the first embodiment is replaced in the sterilizing section chamber 9*a*. That is, the exhaust duct 35 is connected to the sterilizing section chamber 9*a*, and the exhaust blower 36 and the filter 37 are connected to the exhaust duct 35.

Any filter means may be used as such filter 37 as far as it decomposes the hydrogen peroxide into water and oxygen to thereby render the hydrogen peroxide harmless, and activated carbon filter, platinum catalyst and the like may be used as such filter. Further, in place of such filter, it may be used a scrubber which traps the hydrogen peroxide into water, neutralizes it with alkaline agent such as sodium hydrate, and then exhausts it.

The gas in the sterilizing section chamber 9*a* flows into the exhaust duct 35 by the exhaust blower 36, is then filtrated by the filter 37, and thereafter, is exhausted out of the sterilizing section chamber 9*a*. The pressure inside the sterilizing section chamber 9*a* is maintained in a range of −20 Pa to 0 Pa, for example, by the exhaust means. Further, the pressure inside the atmosphere shut-off chamber 32 is maintained in a range of 0 Pa to 5 Pa because the inner air thereof is not sucked out therefrom. As a result, the air-flow from the air supply section chamber 25 disposed upstream side thereof and the air-flow from the rinsing section chamber 10*a* disposed downstream side thereof flow into the sterilizing section chamber 9*a*, and these air-flows are exhausted out of the sterilizing section chamber 9*a* through the exhaust duct 35. Accordingly, the hydrogen peroxide exhausted from the sterilizing section 9 does not flow into the molding section chamber 8*a* disposed upstream side thereof and into the filling section chamber 11*a* disposed downstream side thereof, thereby preventing various equipment or components disposed such as in the molding section 8 from corroding with the hydrogen peroxide.

Furthermore, a portion of the sterilizing section chamber 9*a* into which the bottle 1 travels while being applied with the sterilizer is covered by the tunnel member 49.

According to such arrangement, the hydrogen peroxide mist or gas, or mixture thereof as the sterilizer exhausted from the nozzle 31 flows smoothly into the bottle 1 without being disturbed by the air-flows mentioned above or flows smoothly along the outer surface of the bottle 1.

According to the drink filling system of the second embodiment, the hydrogen peroxide mist or gas, or mixture thereof is blasted to the bottle 1 when the bottle 1 enters the sterilizing section chamber 9*a* and enters the tunnel member 49.

Furthermore, since the interior of the sterilizing section chamber 9*a* is always exhausted by the exhaust blower 36, the pressure therein is maintained in a range of −20 Pa to 0 Pa, for example, lower than the atmospheric pressure, and therefore, the air-flow including the hydrogen peroxide mist is exhausted out of the sterilizing section chamber 9*a* through the exhaust duct 35. In addition, the air for air-rinsing treatment from the interior of the rinsing section chamber 10 disposed downstream side thereof flows into the sterilizing section chamber 9*a* through the atmosphere shut-off chamber 32, and the air from the air supply section chamber 25 also flows into the sterilizing section chamber 9*a*, so that these air-flows involve the surplus hydrogen peroxide mist, which is then flows out of the sterilizing section chamber 9*a* through the exhaust duct 35.

Since the bottle 1 is blasted with the hydrogen peroxide mist or gas, or mixture thereof while travelling in the tunnel member 49, the hydrogen peroxide evenly adheres to the inner and outer surfaces of the bottle 1. Moreover, the bottle is heated with the remaining heat by the heater before the molding treatment and also heated by the clean air heated in the air supply section chamber 25, so that the hydrogen peroxide adhering to the bottle 1 is activated to thereby enhance the sterilizing effect.

According to the structure and operation mentioned above, the hydrogen peroxide exhausted from the sterilizing section 9 does not flow into the molding section chamber 8*a* disposed on the upstream side thereof and into the filling section chamber 11*a* disposed downstream side thereof, thereby preventing the hydrogen peroxide from adhering to the bottle and mixing into the drink in the various equipment or components in the molding section 8 and the filling section 11.

Further, in the present second embodiment, like reference numerals are added to members or sections corresponding to those in the first embodiment, and duplicated explanation is omitted.

Third Embodiment

Figure 6:
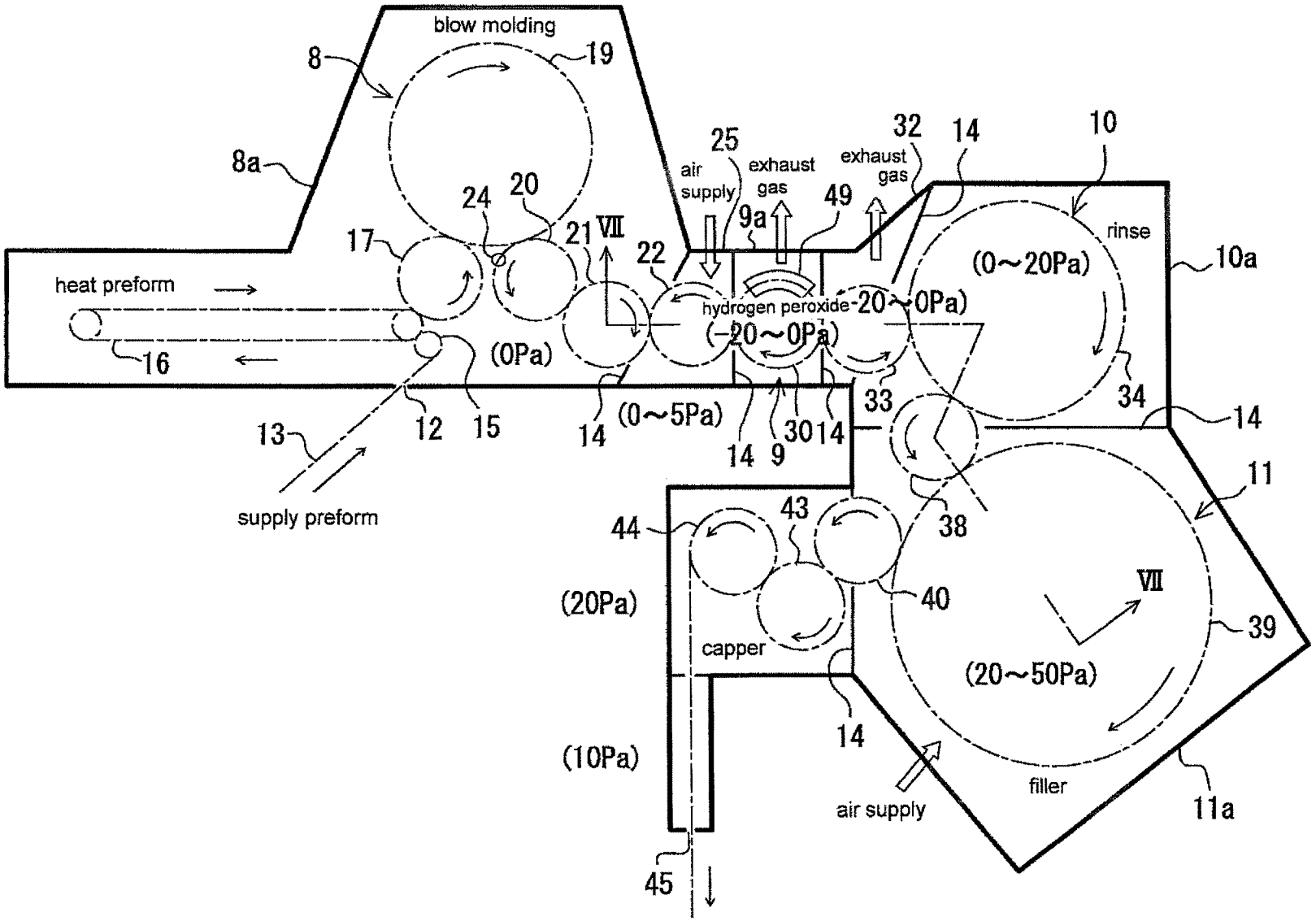
FIG. 6 is a schematic plan view of a drink filling system according to the third embodiment of the present invention.
Figure 7:
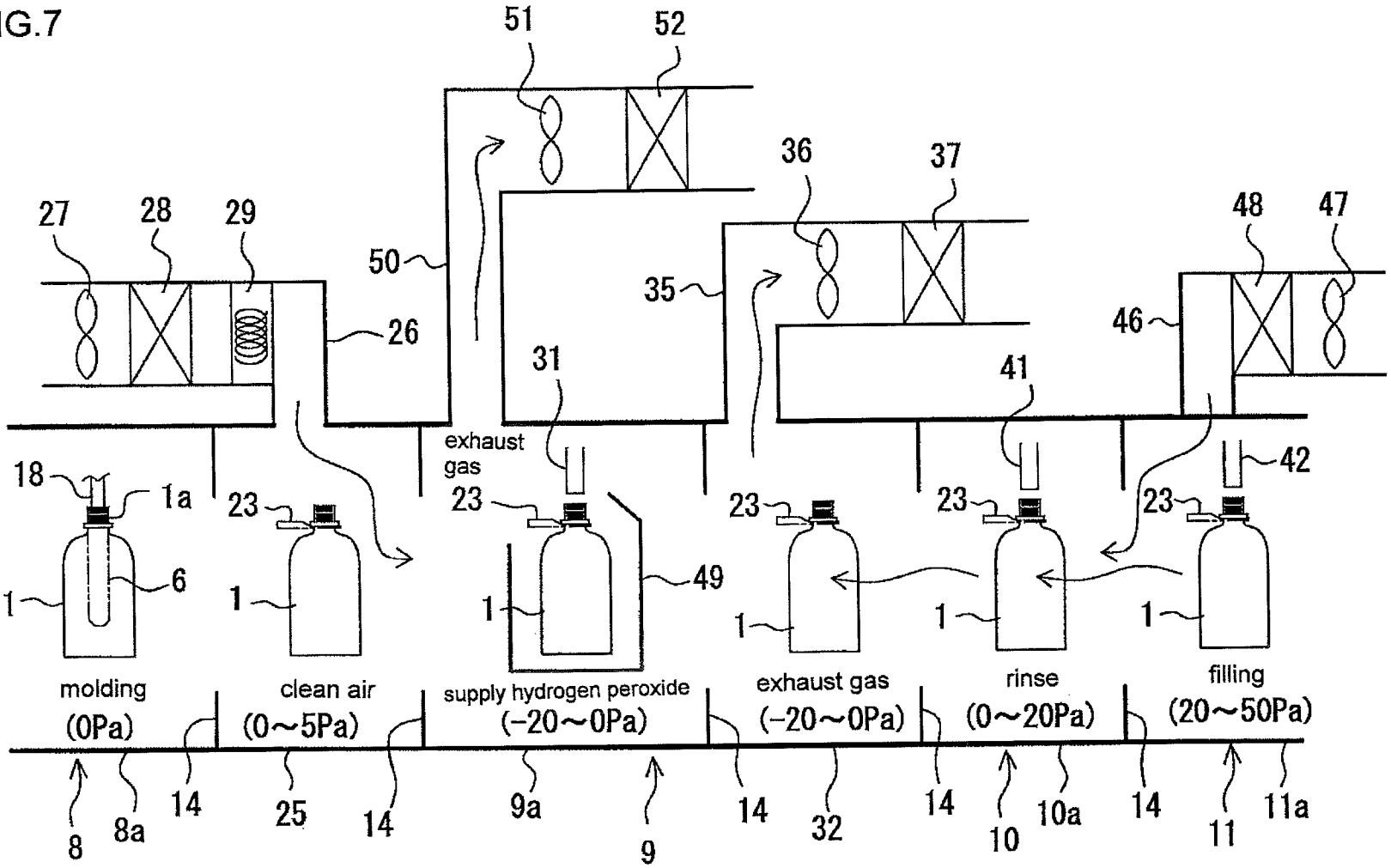
FIG. 7 is a sectional view taken along the line VII-VII shown in FIG. 6.

As shown in FIGS. 6 and 7, the drink filling system of this third embodiment is arranged with the sterilizing section chamber 9*a* on the downstream side of the molding section chamber 8*a* in the bottle conveying direction as like as in the first embodiment, and an air supply section chamber 25 may be arranged between both the chambers 8*a* and 9*a* as occasion demands.

Furthermore, a rinsing section chamber 10*a* is arranged on the downstream side of the sterilizing section chamber 9*a* in the bottle conveying direction, and an atmosphere shut-off chamber 32 is also arranged between both the chambers 9*a* and 10*a*.

However, in the present third embodiment, the exhaust means as like as that disposed in the atmosphere shut-off chamber 32 in the first embodiment is provided for the sterilizing section chamber 9*a*.

That is, an exhaust duct 50 is connected to the sterilizing section chamber 9*a*, and an exhaust blower 51 and a filter 51 are provided for this exhaust duct 50.

The air inside the sterilizing section chamber 9*a* flows into the exhaust duct 50 by the exhaust blower 51 and is then filtrated by the filter 52, and thereafter, the filtrated air is exhausted outside the sterilizing section chamber 9*a*. The pressure inside the sterilizing section chamber 9*a* is maintained, by the exhaust means, in a range of −20 Pa to 0 Pa, for example.

Furthermore, since the air in the atmosphere shut-off chamber 32 is also exhausted by a like exhaust means, the pressure inside the atmosphere shut-off chamber 32 is maintained within a range of −20 Pa to 0 Pa.

As a result, the air-flow from the air supply section chamber 25 located on the upstream side thereof flows into the sterilizing section chamber 9*a*, and is then exhausted outside the sterilizing section chamber 9*a* through the exhaust duct 50. Because of this air-flow, the hydrogen peroxide exhausted from the sterilizing section 9 does not flow into the molding section chamber 8*a* disposed upstream side thereof and into the filling section chamber 11*a* disposed downstream side thereof, thus preventing the equipments and/or components in the molding section 8 or like from corroding with the hydrogen peroxide.

Furthermore, a portion in the sterilizing section chamber 9*a* in which the bottle 1 travels while being applied with the sterilizer is covered by the tunnel member 49.

Accordingly, as mentioned above, the flow of the hydrogen peroxide mist or gas, or mixture thereof smoothly flows into the bottle 1 without being disturbed by the air-flow mentioned above or smoothly flows along the outer surface of the bottle 1.

According to the drink filling system of the present third embodiment, the bottle 1 enters the sterilizing section chamber 9*a* and when the bottle 1 enters the tunnel member 49, the hydrogen peroxide mist or gas, or mixture thereof is blasted to the bottle 1.

Furthermore, since the interior of the sterilizing section chamber 9*a* is always exhausted by the exhaust blower 51, the pressure therein is maintained in a range of −20 Pa to 0 Pa lower than the atmospheric pressure. Therefore, air-flow containing the hydrogen peroxide mist is exhausted outside the sterilizing section chamber 9*a* through the exhaust duct 50.

On the other hand, the air for the rinsing treatment flows into the atmosphere shut-off chamber 32 from the rinsing section chamber 10*a* disposed downstream side thereof, and then flows outside the atmosphere shut-off chamber 32 through the exhaust duct 50 by like exhaust means.

Since the bottle 1 is blasted with the hydrogen peroxide mist or gas, or mixture thereof during the traveling in the tunnel member 49, the hydrogen peroxide mist adheres evenly to the inner and outer surfaces of the bottle 1. Moreover, the bottle 1 is heated with the remaining heat by the heater before the molding treatment and also heated by the clean air heated in the air supply section chamber 25, so that the hydrogen peroxide adhering to the bottle 1 is activated to thereby enhance the sterilizing effect.

According to the structure and operation mentioned above, the hydrogen peroxide exhausted from the sterilizing section 9 does not flow into the molding section chamber 8*a* disposed on the upstream side thereof and into the filling section chamber 11*a* disposed downstream side thereof, thereby preventing the hydrogen peroxide from adhering to the bottle 1 and mixing into the drink in the various equipment or components in the molding section 8 and the filling section 11.

Further, in the present third embodiment, like reference numerals are added to members or sections corresponding to those in the first embodiment, and duplicated explanation is omitted.

REFERENCE NUMERAL

1 - - - bottle
6 - - - preform
8 - - - molding section
8*a* - - - molding section chamber
9 - - - sterilizing section
9*a* - - - sterilizing section chamber
10 - - - rinsing section
10*a* - - - rinsing section chamber
11 - - - filling section
11*a* - - - filling section chamber
25 - - - air supply section chamber
29 - - - heater
32 - - - atmosphere shut-off chamber

The invention claimed is:

1. A drink filling system comprising:
a molding section that molds a bottle from a heated preform by a blow-molding treatment;
a sterilizing section that contacts a sterilizer to the molded bottle:
a rinsing section that rinses the bottle discharged from the sterilizing section;
a filling section that fills the bottle rinsed in the rinsing section with a drink and then seals the bottle filled up with the drink;
a bottle conveying path that continuously conveys the bottle from the molding section to the filling section through the sterilizing section and the rinsing section,
a chamber that covers a portion extending from the molding section to the filling section;
an air supply section chamber disposed on an upstream side of the sterilizing section chamber; and
an exhaust blower in the sterilizing section for exhausting out of the sterilizing section and maintaining a pressure inside the sterilizing section lower than the atmospheric pressure,
wherein the exhaust blower exhausts an air-flow from the air supply section chamber disposed on the upstream side of the sterilizing section chamber and an air-flow from the rinsing section chamber.

2. The drink filling system according to claim 1, further comprising the exhaust blower in the sterilizing section for maintaining a pressure inside the sterilizing section in a range of −20 Pa to 0 Pa.

3. The drink filling system according to claim 1, wherein the air supply section chamber, which has an interior is between the molding section chamber and the sterilizing section chamber;

an atmosphere shut-off chamber that shuts off an atmosphere is between the sterilizing section chamber and the rinsing section chamber; and the exhaust blower in the sterilizing section exhausts an air flowed from the air supply section chamber and the atmosphere shut-off chamber.

* * * * *